US006257193B1

(12) United States Patent
Alpan et al.

(10) Patent No.: US 6,257,193 B1
(45) Date of Patent: Jul. 10, 2001

(54) ENGINE WITH A DIRECT PASSAGE FROM THE OIL RESERVOIR TO THE OIL PUMP

(75) Inventors: Karen A. Alpan, LaGrange; David G. Bergman, Sugar Grove; David L. Rowland, Burr Ridge, all of IL (US)

(73) Assignee: International Truck and Engine Corporation, Chicago, IL (US)

( * ) Notice: Subject to any disclaimer, the term of this patent is extended or adjusted under 35 U.S.C. 154(b) by 0 days.

(21) Appl. No.: 09/397,170

(22) Filed: Sep. 16, 1999

(51) Int. Cl.[7] ..... F01M 11/06
(52) U.S. Cl. ..... 123/196 R
(58) Field of Search ..... 123/195 C, 198 E, 123/196 R; 184/106, 1.5

(56) References Cited

U.S. PATENT DOCUMENTS

| | | | |
|---|---|---|---|
| 3,592,293 | | 7/1971 | Frincke . |
| 4,479,463 | | 10/1984 | Curley et al. . |
| 4,615,314 | | 10/1986 | Baugh . |
| 4,616,609 | | 10/1986 | Munch et al. . |
| 4,616,610 | * | 10/1986 | Ishida ..... 123/196 R |
| 4,875,884 | | 10/1989 | Meisenburg . |
| 4,977,870 | | 12/1990 | Hashimoto et al. . |
| 5,136,993 | | 8/1992 | Ampferer et al. . |
| 5,158,053 | | 10/1992 | Krechberger et al. . |
| 5,411,114 | | 5/1995 | Bedi et al. . |
| 5,601,060 | | 2/1997 | Smietanski et al. . |
| 5,879,140 | | 3/1999 | Ellison . |
| 6,041,752 | * | 3/2000 | Van Klompenburg ..... 123/195 C |

* cited by examiner

*Primary Examiner*—Willis R. Wolfe
*Assistant Examiner*—Hyder Ali
(74) *Attorney, Agent, or Firm*—Dennis Kelly Sullivan; Jeffrey P. Calfa; Gilberto Hernandez

(57) ABSTRACT

The present invention describes an engine having an oil pan (100) with a pick-up tube (140) for moving oil from an oil reservoir (105) to an oil pump (130). An engine crankcase (110) is connected to a front cover (120) having a front half (122) and a back half (124). The oil pan (100) is connected to the crankcase (110) and the front cover (120). A pick-up tube (140) is disposed along the oil pan (100) and connects the oil reservoir (105) to an inlet path (128) formed by the front half (122). A nipple (150) connects to the pick-up tube (140) to the front half by being inserted into an opening (129) of the inlet path (128). A gasket (160) is disposed adjacent to the nipple (150) and between the pick-up tube (140) and the front half (122). An alternate embodiment omits the nipple (150).

33 Claims, 5 Drawing Sheets

ENGINE WITH A DIRECT PASSAGE FROM THE OIL RESERVOIR TO THE OIL PUMP

FIELD OF THE INVENTION

The present invention relates generally to hydraulic systems for engines. More particularly, the present invention relates to internal combustion engines having a pick-up tube in the oil pan for pumping oil from the oil reservoir outside the crankcase to the oil pump inlet.

BACKGROUND OF THE INVENTION

New vehicle designs and additional accessories require an engine to deliver more horsepower. However, the engine needs a larger crankshaft to provide the additional horsepower. A larger crankshaft requires larger main bearing caps for stabilization. To operate the engine properly, the larger crankshaft and bearing caps must be placed lower in the crankcase. This placement eliminates the previously available space for the oil pump inlet tube.

In a typical engine configuration, an oil pump connects to an inlet tube outside the crankcase. The inlet tube connects to the pick-up tube inside the crankcase or inside the oil pan. The pick-up tube is positioned in the oil pan for pumping oil from the oil reservoir formed by the oil pan. When the engine is operating, oil is pumped from the oil reservoir, through the pick-up tube, through the inlet tube, and into the oil pump.

When the inlet tube is moved outside the crankcase, there are more opportunities for leaks to develop. Leaks also may develop from improperly connected pick-up and inlet tubes. Leaks may develop because the oil pan extends beyond the crankcase. Leaks also may develop because the oil pump inlet tube or the pick-up tube extends through a passage formed in the oil pan. In the later two cases, a gap may form along an edge of the oil pan. This scenario is especially true when the oil pan extends to connect to the engine'front cover. In assembly operations, it is extremely difficult to consistently match the edges of the front cover and crankcase from engine to engine. If the edges of the front cover and the crankcase are uneven, a gap will form when the oil pan is attached.

Leaks also are a greater concern when the oil pump inlet tube is moved outside the crankcase. While no leak is desirable, a leak inside the crankcase at the connection of the inlet and pick-up tubes is less consequential. Such a leak would cause oil to leak into the inlet tube or into the crankcase or oil pan. These leaks would have less impact because the crankcase and oil pan are full of oil during engine operation.

In contrast, a leak outside the crankcase would have an adverse impact on engine performance. Such a leak may cause oil to escape from the engine. While it may not cause an immediate problem, it would harm the engine over the long term. Moreover, a leak may cause air to enter the hydraulic system. Air in the hydraulic system would have a catastrophic impact on engine operation.

To avoid some of these leaks, the pick-up tube and the oil pump inlet tube could be one piece. However, they typically are not one piece because of manufacturing costs. The one piece would stick out of the oil pan or the crankcase. This arrangement has a greater chance of being damaged during transportation of the part and assembly of the engine. The combined tube may be hit and may even snap when the part is shipped or the engine moves through the assembly line. Moreover, a combined tube would not prevent leaks from gaps in the oil pan connections.

Accordingly, there is a need for a direct passage from the oil reservoir to the oil pump in an engine that does not pass through the crankcase.

SUMMARY OF THE INVENTION

The present invention provides an engine oil pan with a direct passage from the oil reservoir to the oil pump. A direct passage is one that does not pass through the crankcase. An engine crankcase connects to a front cover having a front half and a back half. The front half forms an inlet path to the oil pump, thus avoiding the need for an oil pump inlet tube. An oil pan connects to the crankcase and the front cover. There may be a gap between the oil pan and the front cover.

The oil pan has a pick-up tube disposed along an oil pan housing, which forms an oil reservoir. The pick-up tube is positioned to take oil from the deeper part of the oil reservoir. The pick-up tube connects the oil reservoir to the inlet path formed in the front half of the front cover.

Preferably, a nipple is connected by interference bonding to the pick-up tube. The nipple also is connected to the front cover by being inserted into the inlet path. The nipple may have a tapered end. The front half may have a tapered portion for receiving the nipple. The tapered end and the tapered portion may have the same taper to make a more secured connection.

An O-ring or a gasket is disposed adjacent to the nipple and between the pick-up tube and the front half. The pick-up tube and the front half each may have a groove for positioning the O-ring. Preferably, the O-ring is wider than the gap between the front cover and the oil pan. When the O-ring is not wider than the gap, the O-ring may be positioned adjacent to the contact point between the nipple and the front cover.

An alternate embodiment omits the nipple. A gasket is disposed between the oil pan and the front cover. Preferably, the gasket is disposed in grooves formed in the oil pan and the front cover.

The following drawings and description set forth additional advantages and benefits of the invention. More advantages and benefits are obvious from the description and may be learned by practice of the invention.

BRIEF DESCRIPTION OF THE DRAWINGS

The present invention may be better understood when read in connection with the accompanying drawings, of which.

DETAILED DESCRIPTION OF THE INVENTION

Figure 1:
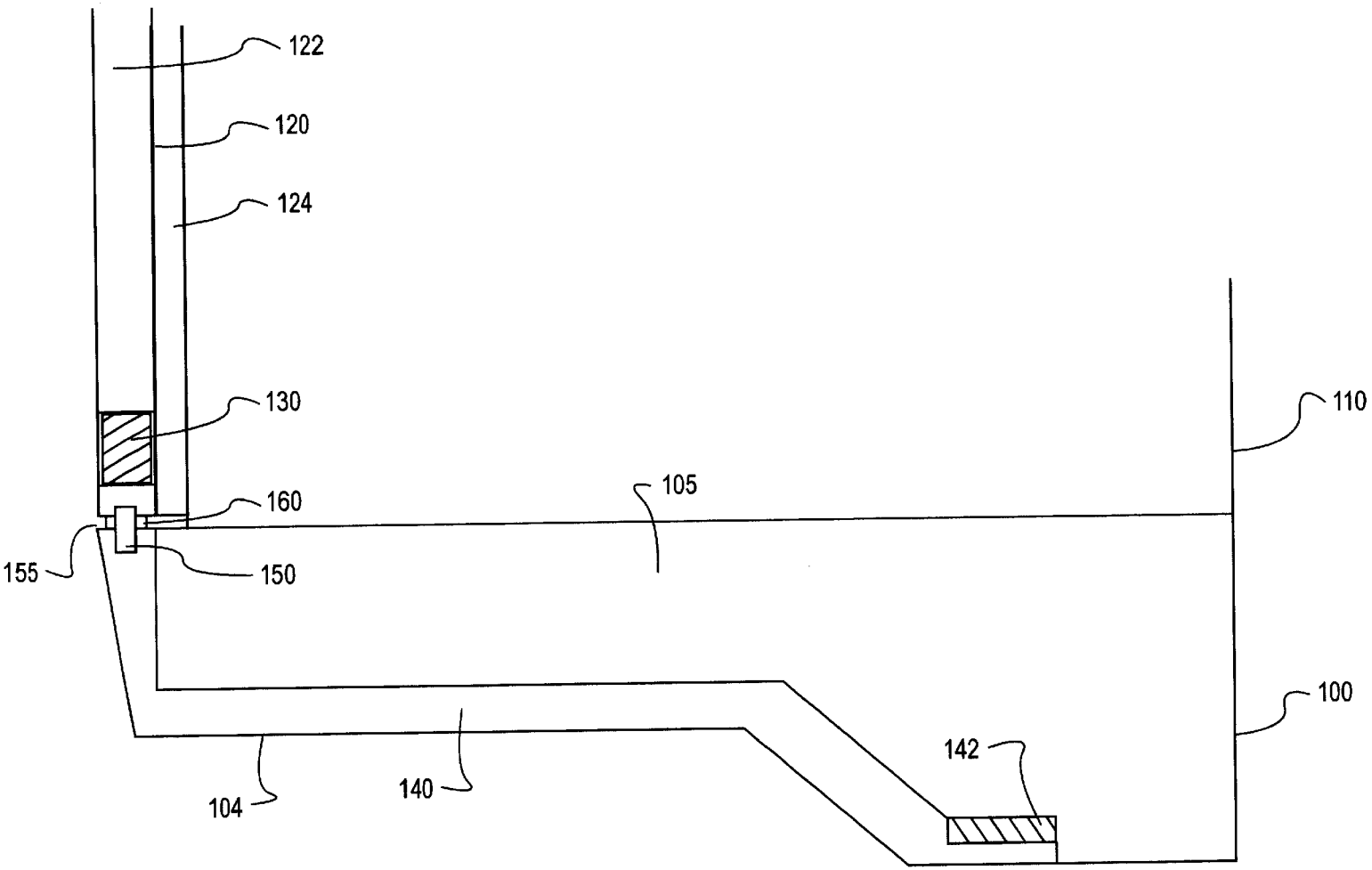
FIG. 1 is a partial side-view of an engine having a direct passage according to the present invention.

FIG. 1 shows a partial side-view of an engine with a direct passage according to the present invention. An oil pan 100 is connected to a crankcase 110 via bolts (not shown). The crankcase 110 connects to a front cover 120 having a front half 122 and a back half 124. The front half 122 forms an inlet path 128 to an oil pump 130. The inlet path 128 has an opening 129 in the front half 122. The oil pan 100 has a housing 104 forming an oil reservoir 105.

The oil pan 100 extends to connect to the front cover 120 via bolts (not shown). Because of manufacturing and machining limitations, there usually is a gap 155 between the oil pan 100 and the front cover 120. The gap 155 may be an intentional feature to ensure a secure fit between the oil pan 100 and the crankcase 110. If there is no gap 155 and the front cover 120 is too large, then the oil pan 100 will not connect properly to the crankcase. Gap 155 could compensate for imprecise machining or manufacturing capabilities. However, gap 155 is not needed or desired when the front cover 120 has the proper dimensions for the oil pan to securely fit the crankcase 110 and the front cover 120.

The oil pan 100 has a pick-up tube 140 positioned to move oil from the oil reservoir 105 to the inlet path 128. The pick-up tube 140 may be positioned anywhere in the oil reservoir 105. Preferably, the pick-up tube 140 is positioned to take oil from the deeper part of the oil reservoir 105. The pick-up tube 140 may have a strainer 142 for catching debris.

The oil pan 100 and pick-up tube 140 preferably are made from cast aluminum with the housing 104 and the pick-up tube 140 integrated as a single part. They also may be cast from iron or steel. Alternatively, the oil pan 100 may be stamped from aluminum or steel. The pick-up tube 140 may be an aluminum or steel tube brazed or welded onto the oil pan 100. In addition, the oil pan 100 and the pick-up tube 140 may be made from plastic separately or integrally. Other materials or a combination of materials also may be used for the oil pan 100 and pick-up tube 140.

A nipple or spud 150 preferably connects the pick-up tube 140 to the front half 122. The nipple 150 is preferably made of the same material as the pick-up tube 140. While different materials may be used, care must be taken so the pick-up tube 140 and the nipple 150 have similar thermal expansions and other material properties necessary for proper operation.

Figure 2:
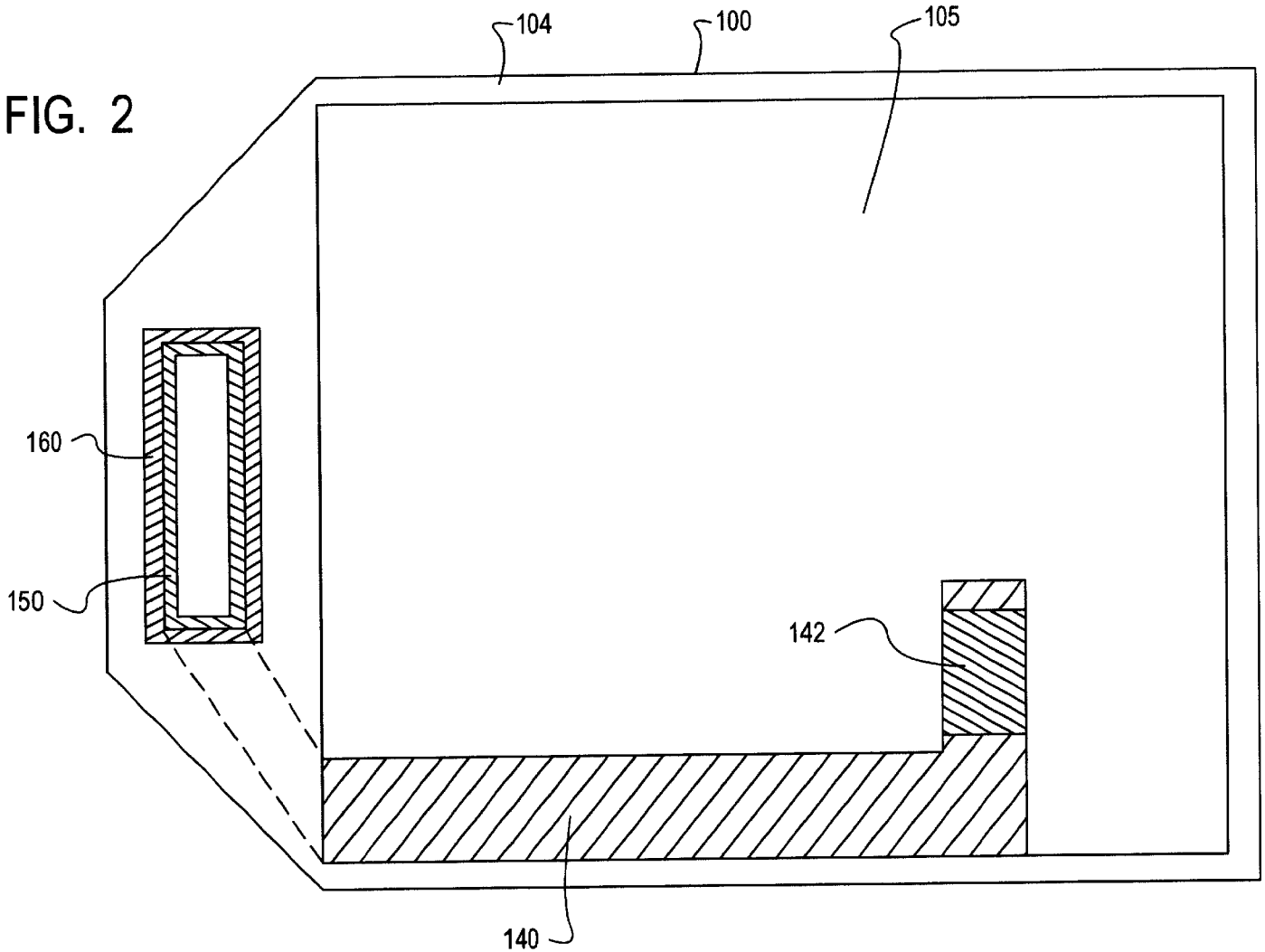
FIG. 2 is a top view of an oil pan having a pick-up tube according to the present invention.

The nipple 150 helps direct oil through the inlet path 128 to the oil pump 130 positioned in the front half 122. When the oil pump 130 is operating the nipple 150 works with an O-ring or carrier type gasket 160 to prevent air from leaking into the inlet path 128. When the oil pump is not operating, the nipple 150 and the O-ring 160 work together to prevent oil from leaking out of the engine. The O-ring 160 surrounds the nipple 150 and is positioned between the front half 122 and the oil pan 100. FIG. 2 shows a top view of the oil pan with the pick-up tube 140, nipple 150, and O-ring 160.

Figure 3:
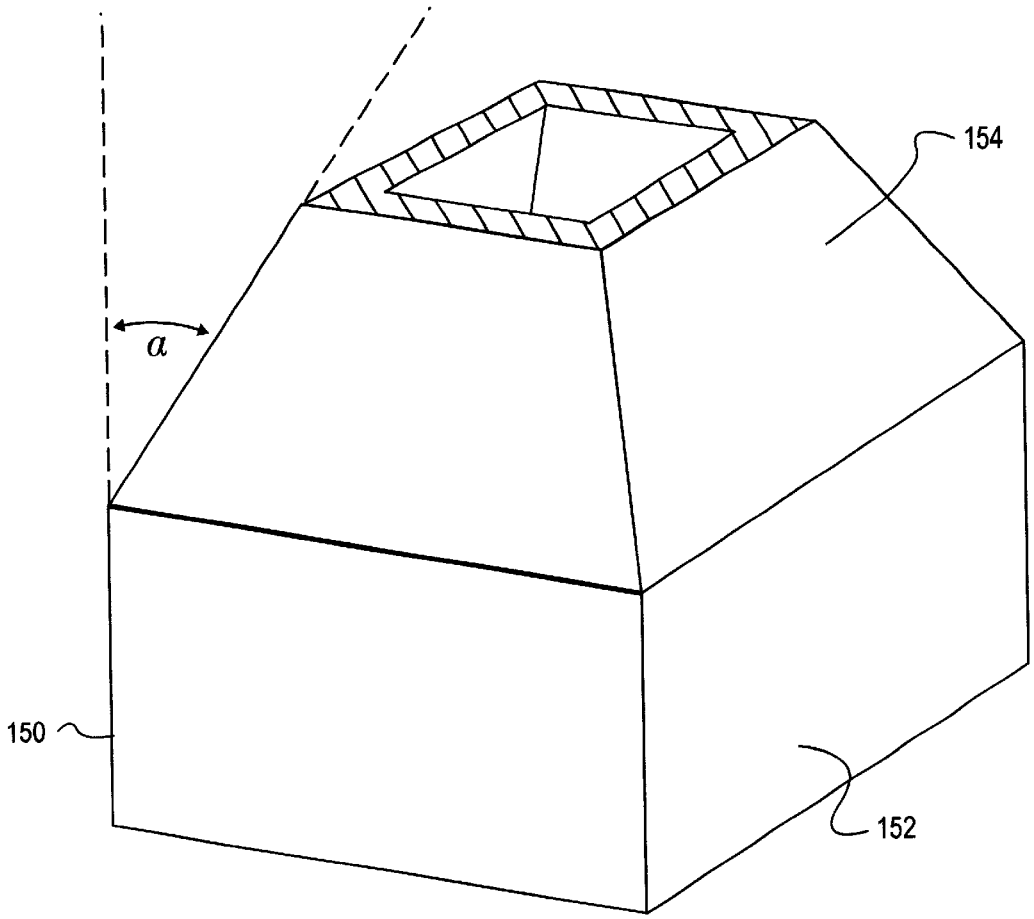
FIG. 3 is a perspective view of a nipple according to the present invention.

FIG. 3 shows the nipple 150 with a full-sized end 152 and a tapered end 154. The taper is exaggerated for illustration purposes. To make manufacturing easier, the nipple 150 preferably has a rectangular or square cubic-shape. However, a circular or oval cylindrical-shape (not shown) is preferred when smoother fluid flow is desired.

The taper is defined by a taper angle, a, measuring the deflection of the tapered end 154 toward the center of nipple 150. While other taper angles may be used, a taper angle of 1° is preferred. The taper is shown to start at the approximate middle of nipple 150. However, the taper end 154 could start anywhere along the nipple 150. In addition, the nipple 150 could be tapered its entire length. While a tapered nipple is preferred, an untapered nipple may be used.

Figure 4:
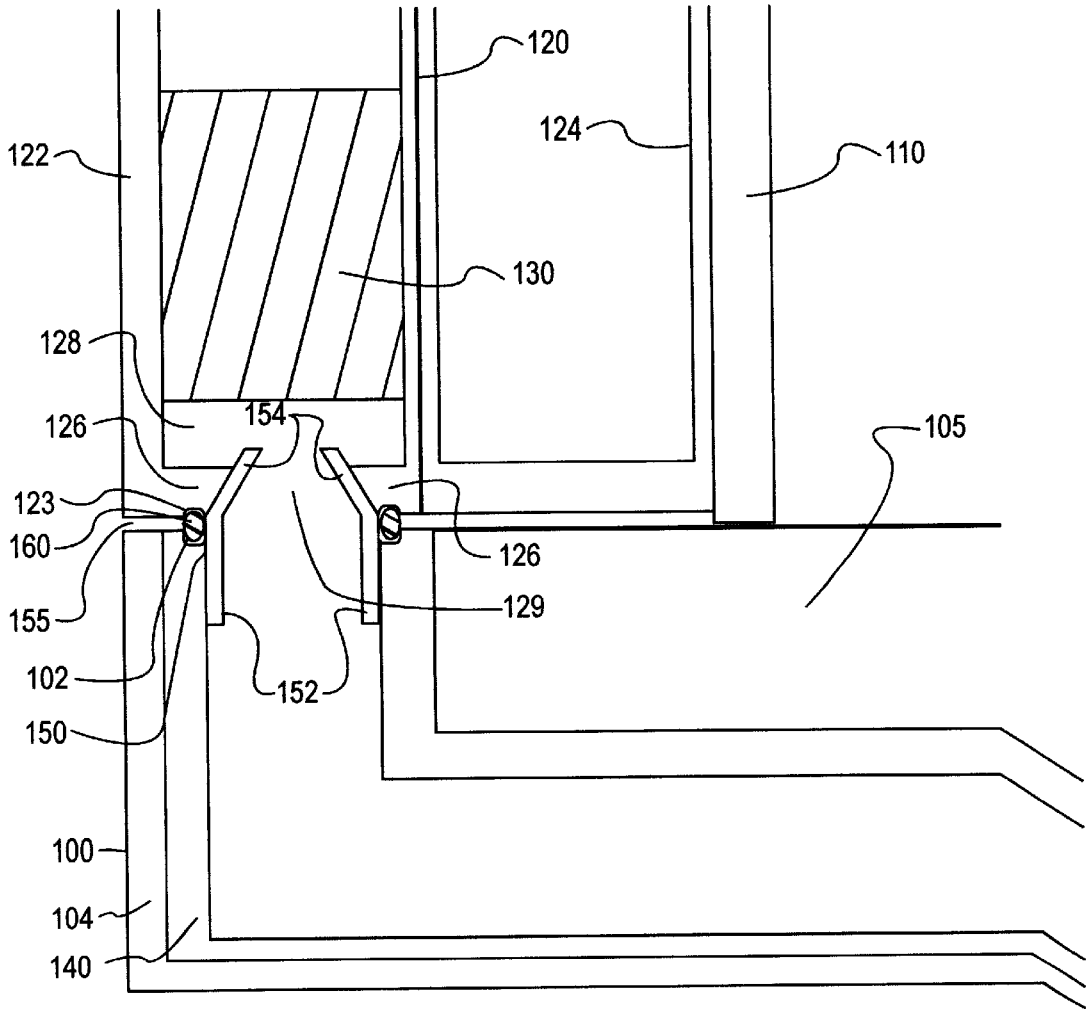
FIG. 4 is a close-up view of the pick-up tube connection to the front cover in FIG. 1 according to the present invention.

FIG. 4 shows a close-up view of the nipple 150 connected to the pick-up tube 140 and the front half 122. The full-sized end 152 of the nipple 150 makes an interference fit with the pick-up tube 140. The pick-up tube has a shape corresponding to the shape of the nipple 150. The outside dimensions of the full-sized end 152 are essentially the same as the inside dimensions of the pick-up tube 140. The nipple 150 preferably is coated for rust protection and interference bonding.

Preferably, the front half 122 has a tapered portion 126 forming an opening 129 for receiving the nipple 150. The opening 129 connects with the inlet path 128. The taper of the tapered end 152 preferably corresponds to the taper of the tapered portion 126. Alternately, the opening 129 may be formed by an untapered front cover.

An O-ring or carrier-type gasket 160 surrounds the nipple 150. The O-ring may be made of plastic, rubber, or other suitable material. The O-ring 160 is positioned in the gap 155 between the front half 122 and the oil pan 100 to prevent leakage, especially between the nipple 150 and the front half 122. Preferably, the pick-up tube 140 has a first groove 102 and the front half 122 has a second groove 123. The first and second grooves 102,123 are for positioning the O-ring 160. While the first and second grooves 102,123 are shown working in tandem, either may be used alone to position the O-ring 160. In which case, the other groove may not be present. Preferably, the O-ring 160 has a larger width than the gap 155 so the O-ring 160 is in compression when the front cover 120 and the oil pan 100 are connected to the crankcase 110. When the O-ring 160 has a smaller width than gap 155, the O-ring 160 is positioned adjacent to the contact point of the front cover 120 and the nipple 150.

Figure 5:
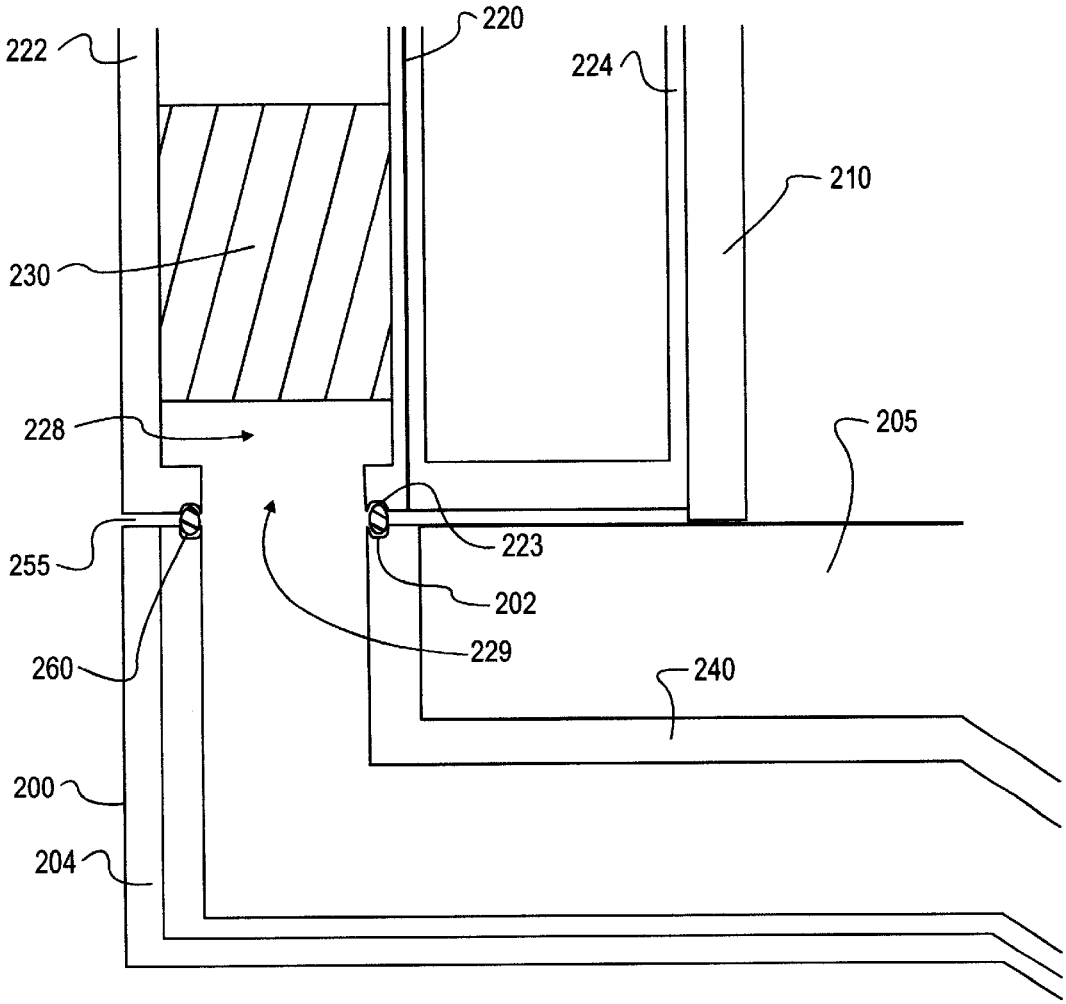
FIG. 5 is a close-up view of an alternate embodiment of an engine having a direct passage according to the present invention.

FIG. 5 shows close-up view of an alternate embodiment without a nipple. An oil pan 200 is connected to a crankcase 210 via bolts (not shown). The crankcase 210 connects to a front cover 220 having a front half 222 and a back half 224. The front half 222 forms an inlet path 228 to an oil pump 230. The oil pan 200 has a housing 204 forming an oil reservoir 205.

The oil pan 200 extends to connect to the front cover 220 via bolts (not shown). Because of manufacturing and machining limitations, there usually is a gap 255 between the oil pan 200 and the front cover 220. Similar to the other embodiment, gap 255 may be an intentional design to compensate for imprecise machining or manufacturing capabilities. Likewise, gap 255 is not needed or desired when the front cover 220 has the proper dimensions for the oil pan to securely fit the crankcase 210 and the front cover 220.

The oil pan 200 has a pick-up tube 240 positioned to pump oil from the oil reservoir 205 to the inlet path 228. The front cover 222 forms an opening 229 for connecting with the pick-up tube 240. Preferably, the inside dimensions of the opening 229 are essentially the same as the inside dimensions of the pick-up tube 240.

A carrier-type gasket or an O-ring 260 is positioned in the gap 255 between the oil pan 200 and the front half 222. The gasket 260 may be made of plastic, rubber, or other suitable material. The gasket 260 has inside dimensions essentially equal to or greater than the inside dimensions of the pick-up tube 240 and the opening 229. Preferably, the pick-up tube 240 has a first groove 202 and the front half 222 has a second groove 123 for positioning the gasket 260. While the first and second grooves 202, 223 are shown working in tandem, either may be used alone to position the gasket 160. In which case, the other groove would not be present. The gasket 260 has a larger width than the gap 255 so the gasket 260 is in compression when the front cover 220 and the oil pan 200 are connected to the crankcase 210.

While the invention has been described and illustrated, this description is by way of example only. Additional advantages will readily occur to those skilled in the art, who may make numerous changes without departing from the true spirit and scope of the invention.

Therefore, the invention is not limited to the specific details, representative devices, and illustrated examples in this description. Accordingly, the scope of the invention is to be limited only as necessitated by the accompanying claims.

What is claimed is:

1. An oil pan with a direct passage for pumping oil from an oil reservoir to an oil pump inlet path, the oil pan comprising:

an oil pan housing forming the oil reservoir;

a pick-up tube internally formed with the oil pan housing, the pick-up tube configured for directly engaging the oil pump inlet path in a front cover;

a gasket operatively positioned on the pick-up tube.

2. An oil pan according to claim 1, wherein the pick-up tube has a groove, and wherein the gasket is disposed in the groove.

3. An oil pan according to claim 1, the oil pan further comprising a nipple connected to the pick-up tube, wherein the gasket is disposed adjacent to a contact point of the nipple and the pick-up tube.

4. An oil pan according to claim 3, wherein the nipple makes an interference connection with the pick-up tube.

5. An oil pan according to claim 3, wherein the nipple is tapered.

6. An oil pan according to claim 1, the oil pan further comprising a strainer attached to the pick-up tube, wherein the strainer is positioned in the oil reservoir.

7. An oil an with a direct passage for pumping oil from an oil reservoir to an oil pump inlet path, the oil pan comprising:

an oil pan housing forming the oil reservoir;

a pick-up tube disposed along the oil pan housing, the pick-up tube configured for engaging the oil pump inlet path;

a gasket operatively positioned on the pick-up tube; and a nipple connected to the pick-up tube, wherein the gasket is disposed adjacent to a contact point of the nipple and the pick-up tube; and wherein the nipple is further tapered.

8. An engine with a direct passage from an oil reservoir to an oil pump, the engine comprising:

a crankcase;

a front cover connected to the crankcase, the front cover forming an inlet path to the oil pump;

an oil pan connected to the crankcase and the front cover, the oil pan forming the oil reservoir;

a pick-up tube integrally formed with the oil pan for pumping oil from the oil reservoir directly to the inlet path, the pick-up tube functionally connected to the front cover; and a gasket operatively disposed between the pick-up tube and the front cover.

9. An engine according to claim 8, wherein the pick-up tube has a groove, and wherein the gasket is disposed in the groove.

10. An engine according to claim 8, wherein the front cover has a first groove, and wherein the gasket is disposed in the first groove.

11. An engine according to claim 10, wherein the pick-up tube has a second groove, and wherein the gasket is disposed in the second groove.

12. An engine according to claim 8, the engine further comprising a nipple connected to the pick-up tube, the nipple engaging the front cover and inserted into the inlet path.

13. An engine according to claim 12, wherein the nipple makes an interference connection with the pick-up tube.

14. An engine according to claim 12, wherein the nipple has a tapered end for engaging the front cover.

15. An engine according to claim 14, wherein the front cover has a tapered portion to receive the nipple, and wherein the tapered end and the tapered portion have essentially the same taper.

16. An engine according to claim 12, wherein the front cover has a tapered portion to receive the nipple.

17. An engine according to claim 12, wherein the oil pan and the front cover form a gap between the pick-up tube and the front cover, and wherein the gasket is disposed adjacent to a contact point of the nipple and the front cover.

18. An engine according to claim 17, wherein the gasket has a width larger than the gap.

19. An engine according to claim 8, wherein the oil pan and the front cover form a gap between the pick-up tube and the front cover, and wherein the gasket has a width larger than the gap.

20. An engine with a direct passage from an oil reservoir to an oil pump, the engine comprising:

a crankcase;

front cover connected to the crankcase, the front cover forming an inlet path to the oil pump;

an oil pan connected to the crankcase and the front cover the oil pan forming the oil reservoir;

a pick-up tube disposed along the oil pan for pumping oil from the oil reservoir to the inlet path, the pick-up tube functionally connected to the front cover;

a gasket operatively disposed between the pick-up tube and the front cover; and nipple connected to the pick-up tube, the nipple engaging the front cover and inserted into the inlet path;

the nipple further having a tapered end for engaging the front cover.

21. An engine according to claim 20, wherein the front cover has a tapered portion to receive the nipple, and wherein the tapered end and the tapered portion have essentially the same taper.

22. An engine with a direct passage from an oil reservoir to an oil pump, the engine comprising:

a crankcase;

front cover connected to the crankcase, front cover forming an inlet path to the oil pump;

an oil pan connected to the crankcase and the front cover the oil pan forming the oil reservoir;

a pick-up tube disposed along the oil pan for pumping oil from the oil reservoir to the inlet path, the pick-up tube functionally connected to the front cover;

a gasket operatively disposed between the pick-up tube and the front cover;

a nipple connected to the pick-up tube, the nipple engaging the front cover and inserted into the inlet path; and the front cover further having a tapered portion to receive the nipple.

23. An engine with a direct passage from an oil reservoir to an oil pump, the engine comprising:

a crankcase;

a front cover connected to the crakcase, the front cover forming an inlet path to the oil pump;

an oil pan connected to the crankcase and the front cover, the oil pan forming the oil reservoir;

a pick-up tube disposed along the oil pan for pumping oil from the oil reservoir to the inlet path, the pick-up tube functionally connected to the front cover;

a gasket operatively disposed between the pick-up tube and the front cover;

a nipple connected to the pick-up tube, the nipple engaging the front cover and inserted into the inlet path;

wherein the oil pan and the front cover form a gap between the pick-up tube and the front cover, and wherein the gasket is disposed adjacent to a contact point of the nipple and the front cover.

24. An engine according to claim 23, wherein the gasket has a width larger than the gap.

25. An engine with a direct passage from an oil reservoir to an oil pump, the engine comprising:

a crankcase:

a front cover connected to the crankcase, the front cover forming an inlet path to the oil pump;

an oil pan connected to the crankcase and the front cover, the oil pan forming the oil reservoir;

a pick-up tube disposed along the oil pan for pumping oil from the oil reservoir to the inlet path, the pick-up tube functionally connected to the front cover;

a gasket operatively disposed between the pick-up tube and the front cover;

wherein the oil pan and the front cover from a gap between the pick-up tube and the front cover, and wherein the gasket has a width larger than the gap.

26. An internal combustion engine with a direct passage from an oil reservoir to an oil pump, the engine comprising:

a crankcase;

a front cover connected to the crankcase, the front cover having a front half and a back half, wherein the front half forms an inlet path to the oil pump, wherein the front half has a first groove adjacent to the inlet path;

an oil pan connected to the crankcase and the front cover, the oil pan forming the oil reservoir;

a pick-up tube integrally formed with the oil pan for pumping oil from the oil reservoir directly to the inlet path, the pick-up tube functionally connected to the front cover, the pick-up tube forming a second groove; and a gasket operatively disposed between the front cover and the pick-up tube, the gasket disposed in at least one of the first and second grooves.

27. An engine according to claim 26, the engine further comprising a nipple connected to the pick-up tube, the nipple engaging the front half and inserted into the inlet path.

28. An engine according to claim 27 wherein the nipple has a tapered end for engaging the front half.

29. An engine according to claim 27, wherein the oil pan and the front cover form a gap between the pick-up tube and the front half, and wherein the gasket is disposed adjacent to a contact point of the nipple and the front cover.

30. An engine according to claim 26, wherein the oil pan and the front cover form a gap between the pick-up tube and the front half, and wherein the gasket has a width larger than the gap.

31. An internal combustion engine with a direct passage from an oil reservoir to an oil pump, the engine comprising:

a crankcase;

a front cover connected to the crankcase, the front cover having a front half and a back half, wherein the front half forms an inlet path to the oil pump, wherein the front half has a first groove adjacent to the inlet path;

an oil pan connected to the crankcase and the front cover, the oil pan forming the oil reservoir;

a pick-up tube disposed along the oil pan for pumping oil from the oil reservoir, the pick-up tube functionally connected to the front cover, the pick-up tube forming a second groove;

a gasket operatively disposed between the front cover and the pick-up tube, the gasket disposed in at least one of the first and second grooves;

a nipple connected to the pick-up tube, the nipple engaging the front half and inserted into the inlet path;

the nipple further having a tapered end for engaging the front half.

32. An internal combustion engine with a direct passage from an oil reservoir to an oil pump, the engine comprising:

a crankcase;

a front cover connected to the crankcase, the front cover having a front half and a back half, wherein the front half forms an inlet path to the oil pump, wherein the front half has a first groove adjacent to the inlet path;

an oil pan connected to the crankcase and the front cover, the oil pan forming the oil reservoir;

a pick-up tube disposed along the oil pan for pumping oil from the oil reservoir, the pick-up tube functionally connected to the front cover, the pick-up tube forming a second groove;

a gasket operatively disposed between the front cover and the pick-up tube, the gasket disposed in at least one of the first and second grooves;

a nipple connected to the pick-up tube, the nipple engaging the front half and inserted into the inlet path;

wherein the oil pan and the front cover form a gap between the picket-up tube and the front half, and wherein the gasket is disposed adjacent to a contact point of the nipple and the front cover.

33. An internal combustion engine with a direct passage from an oil reservoir to an oil pump, the engine comprising:

a crankcase;

a front cover connected to the crankcase, the front cover having a front half and a back half, wherein the front half forms an inlet path to the oil pump, wherein the front half has a first groove adjacent to the inlet path;

an oil pan connected to the crankcase and the front cover, the oil pan forming the oil reservoir;

a pick-up tube disposed along the oil pan for pumping oil from the oil reservoir, the pick-up tube functionally connected to the front cover, the pick-up tube forming a second groove;

a gasket operatively disposed between the front cover and the pick-up tube, the gasket disposed in at least one of the first and second grooves;

wherein the oil pan and the front cover form a gap between the picket-up tube and the front half, and wherein the gasket has a width larger than the gap.

* * * * *